US005673826A

United States Patent [19]

Stolk

[11] Patent Number: 5,673,826

[45] Date of Patent: Oct. 7, 1997

[54] MECHANISM FOR PUTTING ON THERAPEUTIC ELASTIC STOCKINGS

[75] Inventor: Robert Stolk, Tuitjenhorn, Netherlands

[73] Assignee: N.V. Varitex, Netherlands

[21] Appl. No.: 591,584

[22] PCT Filed: Jul. 18, 1994

[86] PCT No.: PCT/NL94/00167

§ 371 Date: Jan. 22, 1996

§ 102(e) Date: Jan. 22, 1996

[87] PCT Pub. No.: WO95/02980

PCT Pub. Date: Feb. 2, 1995

[30] Foreign Application Priority Data

Jul. 23, 1993 [NL] Netherlands ..... 9301304

[51] Int. Cl.[6] ..... A47G 25/90

[52] U.S. Cl. ..... 223/112; 223/111

[58] Field of Search ..... 223/111, 112; 36/9 R, 10, 138; 2/239

[56] References Cited

U.S. PATENT DOCUMENTS

| | | | |
|---|---|---|---|
| 3,401,856 | 9/1968 | Berlin | 223/112 |
| 4,260,083 | 4/1981 | Aslin | 223/111 |
| 4,538,368 | 9/1985 | Mugford | 36/112 |
| 5,356,057 | 10/1994 | Vossen | 223/111 |

FOREIGN PATENT DOCUMENTS

| | | |
|---|---|---|
| 788477 | 10/1935 | France . |
| 478051 | 6/1929 | Germany . |
| 447539 | 11/1986 | Sweden . |
| 455566 | 7/1988 | Sweden . |
| 9105498 | 5/1991 | WIPO . |

*Primary Examiner*—Bibhu Mohanty
*Attorney, Agent, or Firm*—Bookstein & Kudirka, P.C.

[57] ABSTRACT

A mechanism for putting on therapeutic elastic stockings. The mechanism includes a wrapping for wrapping the foot. The wrapping has relatively slidable inner and outer parts of smooth material and a pulling member adapted to protrude from the stocking. Both the inner and outer parts of the wrapping may be pulled away from under the stocking in a manner sliding along each other and stripping along the foot. The wrapping is open at the toe end, and both the inner and outer parts are interconnected at the toe end. The pulling member is adapted to pull the wrapping preferably on the outer part thereof, away at the leg end,

15 Claims, 2 Drawing Sheets

MECHANISM FOR PUTTING ON THERAPEUTIC ELASTIC STOCKINGS

FIELD OF THE INVENTION

The present invention relates to a mechanism for putting on therapeutic elastic stockings.

BACKGROUND OF THE INVENTION

Pulling on therapeutic elastic stockings is a big problem to the elderly, since it requires substantial force to stretch the stocking outwardly and to pull the stocking over the foot, and also because of the friction between the stocking and the skin.

A pull on mechanism to address this problem is known from European patent application 0 497 858. In this prior art mechanism, the outer part consists of a sock and the inner part is a lining connected to the sock at the leg end and is left free at the toe end. A pulling member is connected to the toe end of the sock, and the pull on mechanism should be removed through the open toe end of the elastic stocking by means of the pulling member. Hence, this prior art pull on mechanism is only suited for use with an elastic stocking of the so-called "open toe" type. The open toe type however, forms a minority in comparison to elastic stockings having a closed toe.

SUMMARY OF THE INVENTION

The object of the invention is to provide a pull on mechanism suited both for stockings having an open toe and for stockings having a closed toe.

For this purpose, the invention includes a wrapping open at the toe end and having inner and outer parts interconnected at the toe end. The pulling member is adapted to pull the wrapping, preferably on the outer part thereof, away at the leg end.

Because the invention is always pulled out from the leg end of the stocking which is always open, the invention works independently of the structure of the elastic stocking at the toe. It is enabled to pull out the pull on mechanism upwardly because the wrapping is open at the toe end and the inner and outer parts are interconnected there so that the inner part may be pulled out in a stripping fashion by the outer part or by the toe end of the inner part.

A preferred embodiment of the invention includes a wrapping having longitudinal separating seam with a releasable connection for opening and closing the wrapping.

This embodiment has the advantage that it is not necessary for the pulling member to strip off the wrapping over the full periphery and it allows the pulling member to be attached locally to the outer part of the wrapping. If the pull on mechanism is pulled on such that the pulling member extends over the instep, then the wrapping may be pulled out from the stocking in that position since the wrapping can open due to the then released connection and can move to the upper side of the foot. The advantage thereof is that the wrapping does not have to be pulled around the protruding heel allowing the toe end to be made narrower than the thickest part of the foot and less force is required for the pull out action.

According to the invention it is favorable if the pulling member extends between both parts of the wrapping and is attached thereto at the toe end.

Due to this position of the pulling member, the inner part may be stripped along the skin and the outer part may be stripped along the stocking in order to be removed so that only inside of the double walled wrapping there is a sliding friction which may be kept very low by selection of a material having a very low coefficient of friction with itself.

In this embodiment it is favorable if both parts are interconnected at the leg end leaving free an opening for the pulling member, since in this way there is provided a guide for the pulling member.

An embodiment of invention which is favorable in view of the production technique is characterized in that the inner and outer parts are identical.

A further development of the invention is the inclusion of an elongated connecting member being connectable with the opposite longitudinal sides of at least the outer part by using shape lock elements allowing a longitudinal sliding movement. In this embodiment the connecting member is adapted to be pulled out at the leg end of the wrapping.

With such a connecting member, it is easy to open and close the wrapping of the pull on mechanism.

Closing the wrapping may be facilitated if the elongated connecting member is flattened and is provided on its narrow sides with a longitudinally continuing shape lock adapted to engage around a respective, longitudinal edge embossment of the wrapping.

Due to this embodiment of the connecting member and the shape locks, the shape locks of the connecting member only have to be arranged around the respective embossments at the end thereof. In this fashion the wrapping is automatically closed by sliding the connecting member relative to the embossments. Of course, the shape locks and embossments may also be exchanged.

Furthermore, it is advantageous if the wrapping tapers from the leg end to the toe end.

Due to this taper configuration, the inner and outer parts may be interconnected, if desired, at the position of their longitudinal side edges without this hindering the stripping movement of the inner and outer parts.

BRIEF DESCRIPTION OF THE DRAWINGS

The invention will hereafter be described with reference to the drawing schematically showing an embodiment of the invention by way of example.

DETAILED DESCRIPTION

Figure 1:
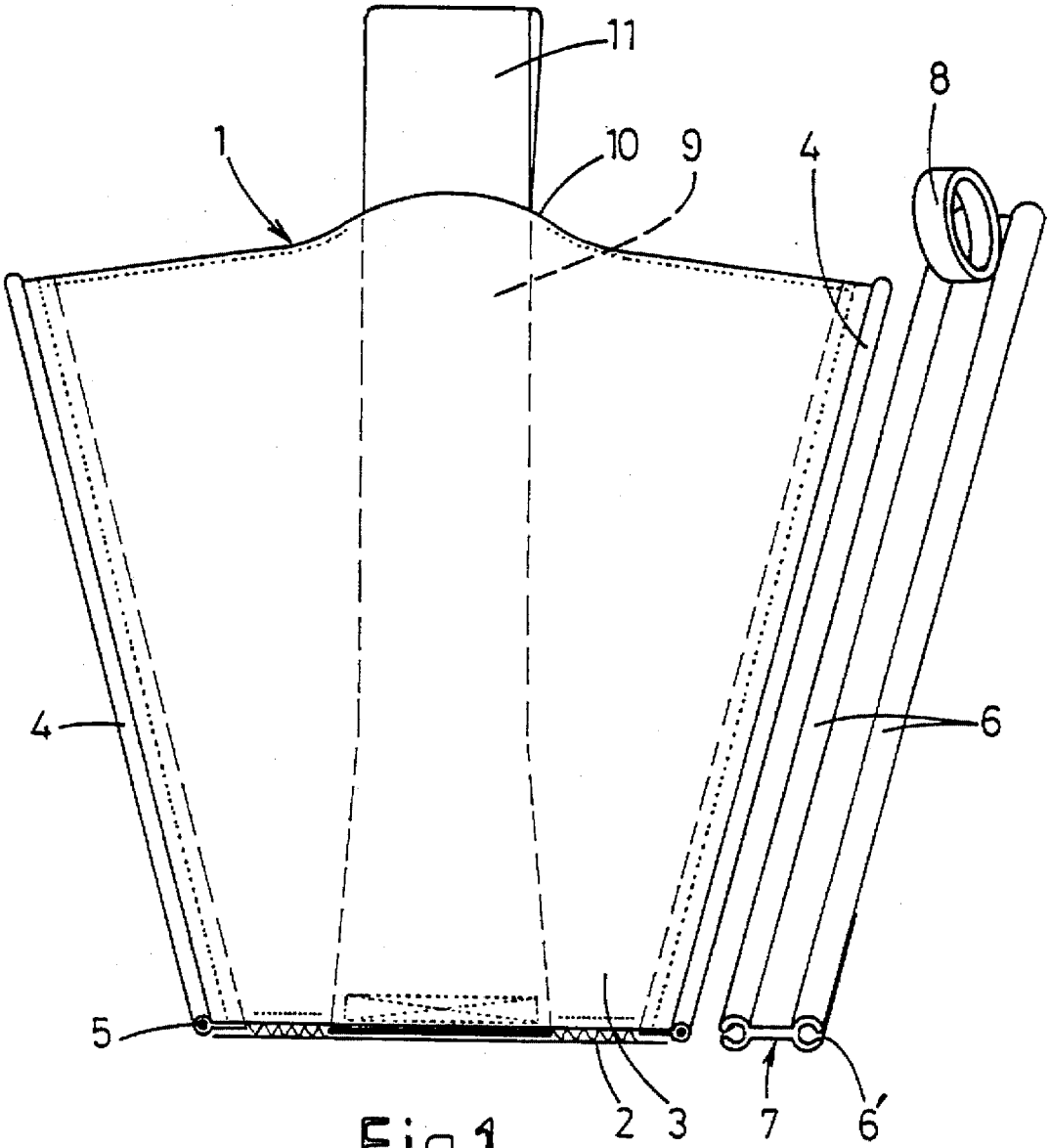
FIG. 1 is a front view of a pull on mechanism with open wrapping and separately shown connecting member.
Figure 2:
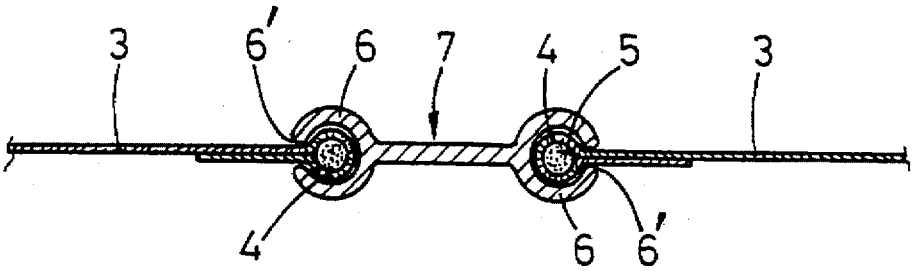
FIG. 2 is an enlarged cross sectional view of a connection for a separating seam of the wrapping of the mechanism of FIG. 1.

The drawing and firstly FIG. 1 shows an exemplary embodiment of the invention for pulling on therapeutic elastic stockings. The invention includes a wrapping 1 for wrapping the foot of a person, said wrapping 1 being shown in FIG. 1 in spread condition. The wrapping 1 consists of an inner part 2 and an outer part 3 which are made of thin, flexible and smooth material, such as nylon fabric having a teflon coating. In this case, the inner and outer parts have an equal shape, are coextensively positioned one on top of the other, and are substantially interconnected at the leg and toe ends. To form the inner and outer parts 2, 3 into the wrapping 1, the opposite longitudinal edges of the outer part 3 comprise embossments 4 extending the full length which are formed by a cord 5 or the like that is sewn into the hem of the outer part 3. A connecting member 7 comprises shape locks 6 having longitudinal slots 6' to engage around the respective embossments 4. The shape locks 6 are formed along the full length of the narrow sides of the flattened elongated connecting member 7. By sliding the embossments 4 of the wrapping 1 into the respective form locks 6 of the connecting member 7, the wrapping 1 may be closed. In order to slide the connecting member in and out it includes a pulling ring 8.

The invention further includes a pulling member in the form of a pulling strip 9 arranged between the inner part 2 and the outer part 3 and connected with its broader end to the narrower toe end of the wrapping 1, for example by stitching. At the broader leg end of the wrapping 1, the pulling strip 9 protrudes outwardly through an opening 10, and at this end the pulling strip may for example comprise a strap 11 (FIG. 3) to allow a proper grip on the pulling strip 9. Because at the leg end of the inner and outer parts 2, 3 only a small opening 10 is left free and the remaining portion of the end is closed, there will be a guide of the pulling strip 9 in the desired direction when the strip is pulled.

Figure 3:
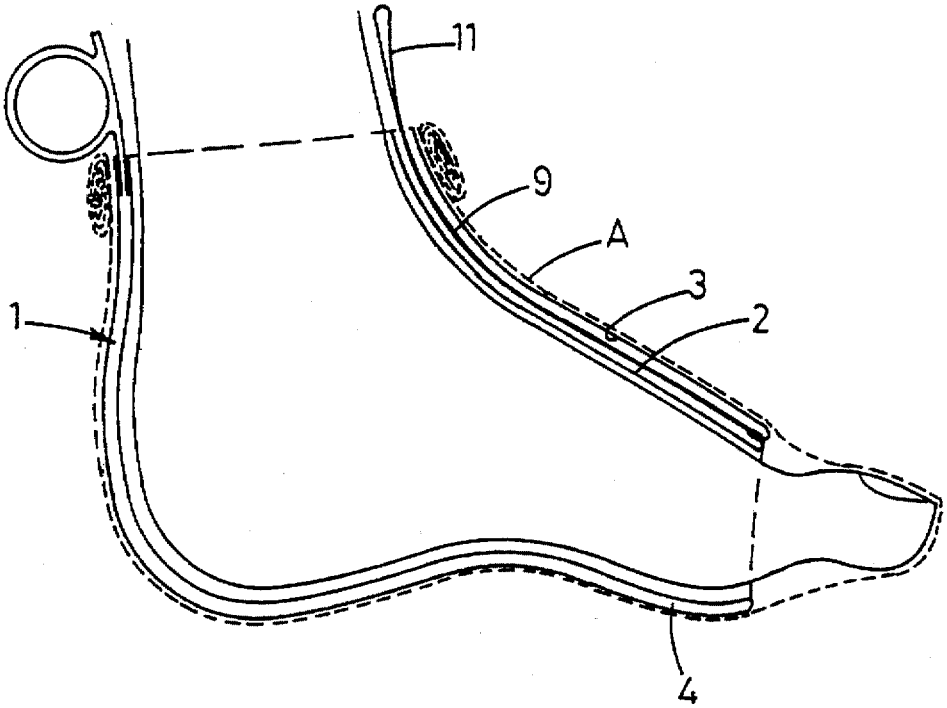
FIG. 3 is a side view of a foot including the mechanism according to the invention and a therapeutic elastic stocking pulled on over it.
Figure 4:
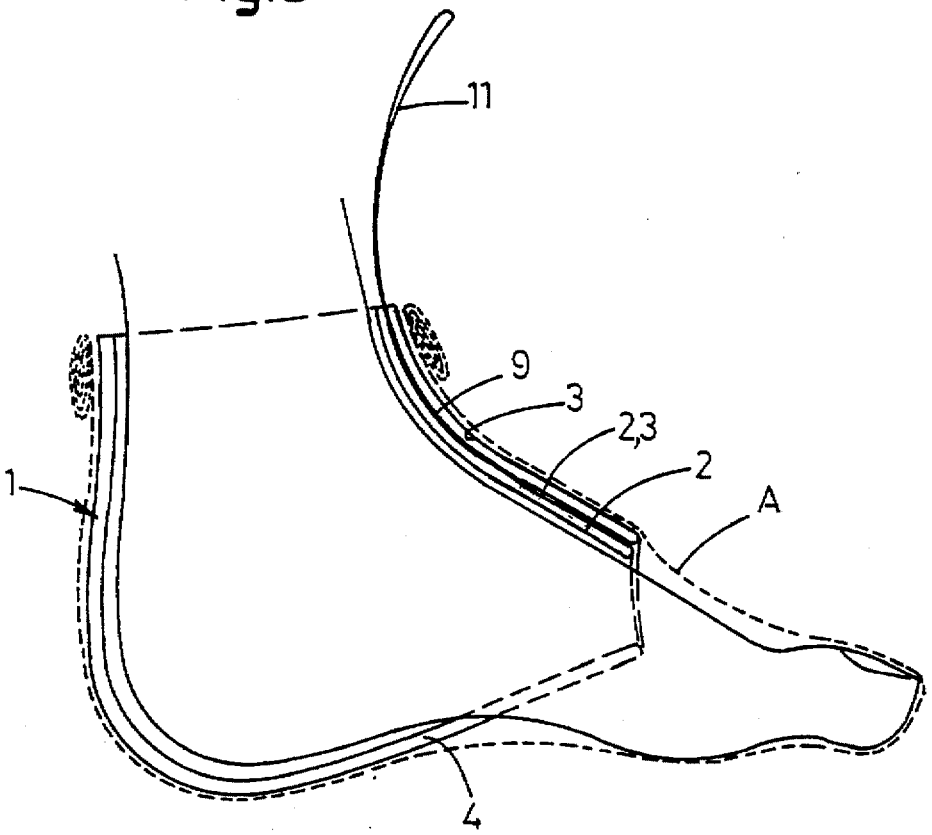
FIG. 4 is a view corresponding to that of FIG. 3, in which, however, the mechanism is partially pulled away from under the stocking.

FIG. 3 and 4 illustrate the use of the pull on mechanism according to the invention. For this purpose, the wrapping 1 is first closed by introducing the embossments 4 of the wrapping 1 into their respective Shape locks 6 of the connecting member 7. The wrapping 1 may then be pulled on like a sock, wherein the pulling strip 9 is on the instep of the foot and the connecting member 7 is at the sole and heel of the foot. Of course, it would also be possible to give the wrapping 1 another configuration or to pull on the wrapping 1 around the foot in another way so that the pulling strip 9 and connecting member 7 are positioned in another position with respect to the foot.

In FIG. 3 it is shown that the inner part 2 and the outer part 3 of the wrapping 1 together form a kind of double walled sock having an open toe, and the pulling strip 9 extends inside this double wall. With the wrapping 1, which is made of smooth material, around the foot it is easy to pull a therapeutic elastic stocking A around the foot since the friction between the outer side of the wrapping 1 and the stocking A is small. The Stocking A is pulled on to such extent that at least the strap 11 of the pulling strip 9 still projects above it.

In order to remove the pull on mechanism after the stocking A has been pulled on around the foot, the connecting member 7, which may be gripped at a level of the ankle of the foot, is first pulled off from the embossment 4 thereby opening the wrapping 1 in longitudinal direction. Thereafter, as is shown in FIG. 4, one pulls at the pulling strip 9 so as to pull the front toe end of the inner and outer parts 2, 3 upwardly within the spacing between the inner and outer parts 2, 3, and as a result, the inner part 2 is stripped off the foot and the outer part 3 is stripped off on the inner side of the stocking A. The wrapping 1 is thereby removed within itself so that only internally of the wrapping 1 there is a sliding movement with a very low friction and there is hardly any sliding movement along the stocking and the foot which makes it very easy to pull the wrapping 1 away from below the stocking A.

From the foregoing it will be clear that the invention provides a pull on mechanism which is very well suited for all types of therapeutic elastic stockings both with a closed and open toe. The means is easy to use and simplifies the pull on operation of the stockings substantially.

The invention is not restricted to the embodiment shown in the drawing and described above and may be varied in different manners within the scope of the invention. For example, the pulling member may also be attached to the outer side of the outer part of the wrapping and although, when the wrapping is pulled away from below the stocking, the outer part slides along the inner side of the stocking and only the inner part is stripped off along the foot, the smoothness of the material of the wrapping will minimize the friction against the stocking. The mechanism may be delivered in different sizes to adapt it to different foot sizes. Also the connection at the separating seam may have another structure, the connecting member may consist of a flexible threading bar which may be threaded through eyelets in the wrapping on both sides of the separating seam.

I claim:

1. An apparatus for putting on a therapeutic elastic stocking, comprising:

a wrapping for the foot, said wrapping being provided with relatively slidable inner and outer parts of smooth low friction material and a pulling member for protruding from the stocking after the stocking is pulled over the wrapping, the pulling member being connected to at least one of the inner and outer parts so that the pulling member may be pulled away from under the stocking causing the inner and outer parts to slide along each other while stripping along the foot and both the inner and outer parts are interconnected at the toe end, and wherein the pulling member is connected to pull the wrapping away at the leg end.

2. An apparatus according to claim 1, wherein the wrapping comprises a longitudinal separating seam having a releasable connection for opening and closing the wrapping.

3. An apparatus according to claim 1, wherein the pulling member extends between both the inner and outer parts of the wrapping and is attached thereto at the toe end.

4. An apparatus according to claim 3, wherein both the inner and outer parts are interconnected at the leg end leaving free an opening for the pulling member.

5. An apparatus according to claim 1, wherein the inner part and the outer part have an equal shape.

6. An apparatus according to claim 2, wherein the releasable connection includes an elongated connecting member for connecting opposite longitudinal sides of at least the outer part of the wrapping allowing a longitudinal sliding movement, said connecting member being adapted to be pulled out at a leg end of the wrapping.

7. An apparatus according to claim 6, wherein the elongated connecting member is flat and is provided on its narrow sides with a longitudinally continuing shape lock adapted to engage around a respective, longitudinal edge embossment of the wrapping.

8. An apparatus according to claim 1 wherein the wrapping tapers from a leg end to a toe end.

9. A device for putting on open-toe or closed-toe therapeutic elastic stockings comprising:

a double layer sleeve of low friction material having a toe end and a leg end, that is receptive to a foot within the sleeve with both layers around the foot and having a pulling member extending between the two layers, connected at one end to at least one of the layers and protruding from between the layers at the other end so that it may be gripped and pulled to separate the sleeve from between the foot and stocking.

10. A device for putting on an open toe or closed toe therapeutic elastic stocking, comprising:

a wrapping for the foot having a toe end and a leg end, said wrapping being provided with relatively slidable inner and outer parts of low friction material each part having inside and outside surfaces and the wrapping having a pulling member connected to both inner and outer parts so that the wrapping may be pulled away from under the stocking by causing the inner and outer parts each to invert so that their inside surfaces slide along themselves while the outside surfaces strip away from the foot and stocking, wherein both the inner and outer parts are interconnected at the toe end, and wherein the pulling member is connected to pull the wrapping away at the leg end.

11. A method for putting on a therapeutic elastic stocking comprising:

providing a wrapping for the foot having relatively slidable inner and outer parts of low friction material, a pulling member joined to at least one of the parts and a releasable seam connector joining the ends of the wrapping;

joining the ends of the wrapping together at the releasable seam to close the wrapping;

sliding the closed wrapping over the foot;

sliding the therapeutic sock onto the foot, over the wrapping;

releasing the seam;

pulling the pull member to strip the wrapping away from between the foot and stocking such that the inner and outer parts slide along each other.

12. An apparatus according to claim 1, wherein the inner and outer parts are arranged one on top of the other.

13. An apparatus according to claim 1, wherein the inner and outer surfaces slide in the direction of pulling when the pulling member is pulled.

14. An apparatus according to claim 9, wherein the double layer sleeve comprises a longitudinal separating seam having a releasable connection for opening and closing the sleeve.

15. An apparatus according to claim 10, wherein the wrapping comprises a longitudinal separating seam having a releasable connection for opening and closing the wrapping.

* * * * *